US008851032B2

(12) United States Patent
Tada

(10) Patent No.: US 8,851,032 B2
(45) Date of Patent: Oct. 7, 2014

(54) VALVE TIMING CONTROLLER

(75) Inventor: Kenji Tada, Kariya (JP)

(73) Assignee: Denso Corporation, Kariya (JP)

( * ) Notice: Subject to any disclaimer, the term of this patent is extended or adjusted under 35 U.S.C. 154(b) by 135 days.

(21) Appl. No.: 13/604,823

(22) Filed: Sep. 6, 2012

(65) Prior Publication Data

US 2013/0068184 A1 Mar. 21, 2013

(30) Foreign Application Priority Data

Sep. 15, 2011 (JP) ..... 2011-201747

(51) Int. Cl.
*F01L 1/34* (2006.01)
*F01L 1/344* (2006.01)

(52) U.S. Cl.
CPC ..... *F01L 1/3442* (2013.01); *F01L 2001/34469* (2013.01); *F01L 2250/02* (2013.01); *F01L 2001/3443* (2013.01); *F01L 2001/34433* (2013.01); *F01L 2250/04* (2013.01); *F01L 2101/00* (2013.01)
USPC ..... 123/90.17

(58) Field of Classification Search
USPC ..... 123/90.15, 90.17
See application file for complete search history.

(56) References Cited

U.S. PATENT DOCUMENTS

| | | | | |
|---|---|---|---|---|
| 3,868,991 | A | 3/1975 | Sheppard | |
| 6,899,126 | B2 | 5/2005 | Weigand et al. | |
| 7,000,580 | B1 * | 2/2006 | Smith et al. | 123/90.17 |
| 7,600,531 | B2 | 10/2009 | Patze et al. | |
| 2001/0009096 | A1 | 7/2001 | Eguchi et al. | |
| 2001/0018930 | A1 * | 9/2001 | Katsura | 137/540 |
| 2002/0100507 | A1 * | 8/2002 | Hauser et al. | 137/540 |
| 2005/0252561 | A1 * | 11/2005 | Strauss et al. | 137/625.68 |
| 2007/0204824 | A1 | 9/2007 | Strauss et al. | |
| 2012/0145099 | A1 | 6/2012 | Kato et al. | |

OTHER PUBLICATIONS

P.L. Hurricks.*
Office Action (6 pages) dated Jun. 5, 2014, issued in corresponding Chinese Application No. 201210337994.7 and English translation (3 pages).

* cited by examiner

*Primary Examiner* — Thomas Denion
*Assistant Examiner* — Steven D Shipe
(74) *Attorney, Agent, or Firm* — Nixon & Vanderhye P.C.

(57) ABSTRACT

A variable-camshaft-timing mechanism is provided with a conically spiral spring valve as a check valve. When the conically spiral spring valve is opened, a plurality of flow passage clearances are formed between adjacent windings of the check valve, whereby a pressure loss of the working fluid can be reduced when passing through the check valve. When a reverse flow is generated, the check valve receives the reverse flow in its axial direction. Thus, the reverse flow of the working fluid can be utilized as a thrust force in a close direction of the check valve. A valve closing responsiveness of the check valve can be improved.

3 Claims, 3 Drawing Sheets

VALVE TIMING CONTROLLER

CROSS-REFERENCE TO RELATED APPLICATION

This application is based on Japanese Patent Application No. 2011-201747 filed on Sep. 15, 2011, the disclosure of which is incorporated herein by reference.

TECHNICAL FIELD

The present disclosure relates to a valve timing controller which varies a rotational phase of a camshaft relative to a crankshaft of an internal combustion engine. The camshaft is driven by the engine to open/close an intake valve and/or an exhaust value. The valve timing controller varies the rotational phase of the camshaft by using of hydraulic pressure and is referred to as a VVT-controller, hereinafter.

BACKGROUND

A VVT-controller adjusting a valve timing of an intake valve includes: a variable-camshaft-timing mechanism which adjusts a rotational phase of an intake camshaft by using of a differential hydraulic pressure between a pressure in an advance chamber and a pressure in a retard chamber; an oil flow control valve (OCV) which controls the differential hydraulic pressure; and an electric actuator which drives the OCV. The variable-camshaft-timing mechanism is referred to as a VCT-mechanism, hereinafter.

The electric actuator is driven by an engine control unit (ECU) to control an operation condition of the OCV, whereby the hydraulic pressure in the advance chamber and the retard chamber is controlled so that the rotational phase of the camshaft is adjusted relative to the crankshaft.

While the engine is ON, a vane rotor of the VVT-controller receives torque fluctuations transmitted to the camshaft. The hydraulic pressure in the advance chamber and the retard chamber also fluctuate due to the torque fluctuations transmitted to the vane rotor from the camshaft.

As a result, the hydraulic pressures in the advance chamber and the retard chamber alternately increase and decrease due to the torque fluctuations. In order to restrict deterioration in responsiveness of the VVT-controller, a check valve is provided in an oil-supply passage so as to prevent a reverse flow from the chambers to an oil pump.

JP-2005-325841A (US-2005/0252561A1) shows an arrangement of a check valve. A spool has a spool passage therein. Working fluid flows in the spool passage toward an advance chamber and a retard chamber. A check valve is arranged in this spool passage.

The check valve includes a ball valve opening/closing the spool passage and a coil spring biasing the ball valve toward a valve seat.

Even when the check valve is opened, a flow passage clearance between the ball valve and the valve seat is relatively small. Thus, enough quantity of the working fluid can not pass through the flow passage clearance and a pressure loss of the working fluid is increased due to the check valve. It may cause deterioration in responsiveness of the VVT-controller.

Meanwhile, when a reverse flow is generated, the ball valve receives the reverse flow on its spherical outer surface so that the flow passage is closed. However, a thrust force is hardly generated on the ball valve by the reverse flow. For this reason, a valve-closing-responsiveness of the check valve is deteriorated, so that the responsiveness of the VVT-controller is also deteriorated.

SUMMARY

It is an object of the present disclosure to provide a valve timing controller having a variable-camshaft-timing mechanism of which responsiveness is enhanced.

A variable-camshaft-timing mechanism is provided with a conically spiral spring valve as a check valve in a spool. When the check valve is opened, a plurality of fluid-passage clearances are ensured between the windings. Thus, a pressure loss of the working fluid can be reduced and the responsiveness of a VVT-controller can be improved.

When a reverse flow is generated, the flat surface of each winding receives the reverse flow. Thus, the reverse flow of the working fluid can be utilized as a thrust force in a close direction of the check valve. A valve closing responsiveness of the check valve and the responsiveness of the VVT-controller can be improved.

A sliding plug fixed to the spool has a flow-direction-changing portion which changes a fluid flow direction from a radial direction to an axial direction. A working fluid from a pump port is introduced into a spool passage by the flow-direction-changing portion. A working-fluid flow direction is changed into an axial flow direction directing to the check valve. Thus, the direction of the working fluid flow is coincident with a valve opening direction of the check valve. For this reason, a valve-opening-responsiveness of the check valve is enhanced, so that the responsiveness of the VVT-controller is also enhanced.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
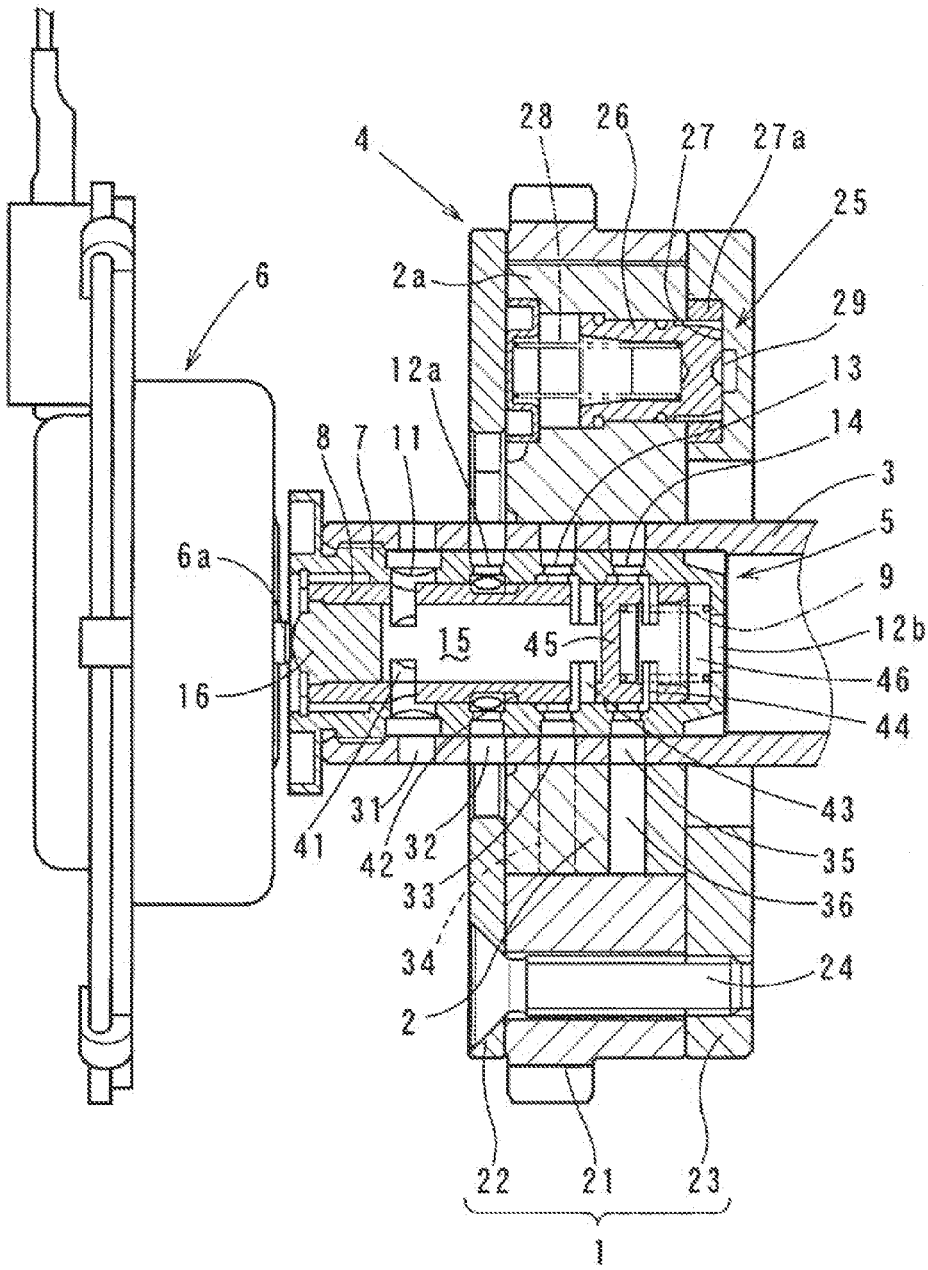
FIG. 1 is a longitudinal sectional view showing a VVT-mechanism and an oil flow control.

A VVT-controller is provided with: a VCT-mechanism 4 which rotates a shoe-housing 1 and a vane rotor 2 in a rotational direction relatively by using of a differential pressure between fluid in an advance chamber and fluid in a retard chamber, so that a rotational phase of a camshaft 3 connected to a vane rotor 2 is varied; an oil control valve (OCV) 5 which controls hydraulic pressure in the advance chamber and the retard chamber, respectively; an electric actuator 6 which drives the OCV 5; and an electronic control unit (ECU: not shown) which controls the electric actuator 6 according to a driving state of an engine.

The OCV 5 is a spool valve which is provided with: a sleeve 7 which is inserted and connected to the camshaft 3; a spool 8 which is slidably accommodated in the sleeve 7 in its axial direction in order to adjust a communicating condition of each port; and a return spring 9 which biases the spool 8 in an axial direction opposite to a driving direction of the electric actuator 6.

The sleeve 7 is cylindrically shaped to have a cylindrical space therein. The sleeve 7 has a pump port (inlet port) 11 through which pressurized oil is introduced therein, drain ports 12*a*, 12*b* communicating with a drain space, an advance port 13 communicating with an advance chamber, and a retard port 14 communicating with a retard chamber. The pump port 11, the advance port 13 and the retard port are formed in such a manner as to radially penetrate the sleeve 7. Besides, the drain ports 12*a*, 12*b* can be formed in such manner as to radially penetrate the sleeve 7, or can be formed in an axial direction of the sleeve 7. Alternatively, the drain ports 12*a*, 12*b* can be formed radially and axially relative to the sleeve 7.

Figure 3A:
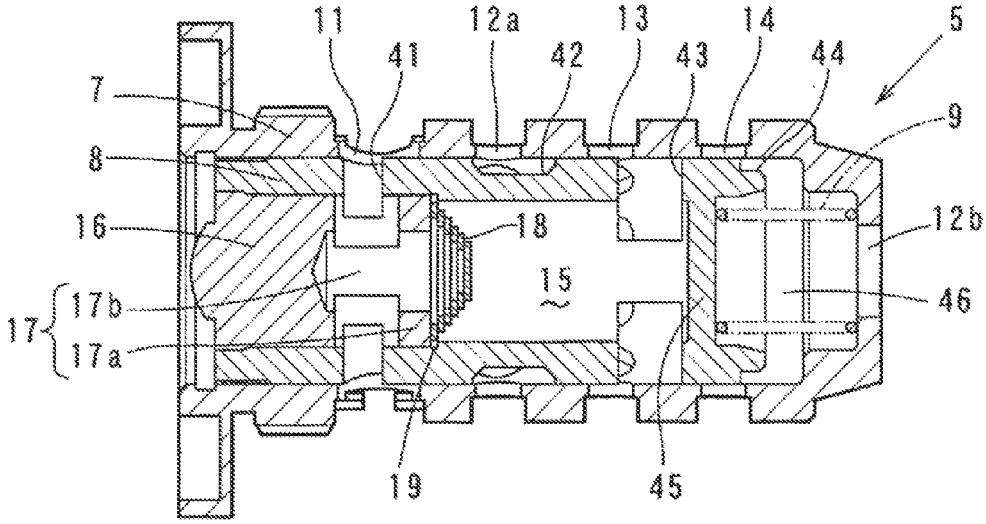
FIG. 3A is a longitudinal sectional view showing a spool valve in which the conically spiral spring valve is closed.
Figure 3B:
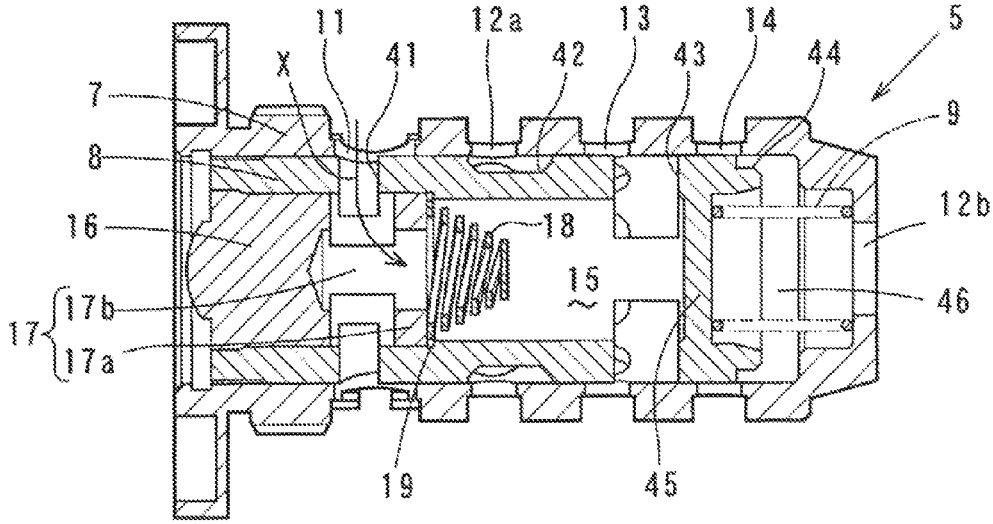
FIG. 3B is a longitudinal sectional view showing the spool valve in which the conically spiral spring valve is opened.

The spool 8 defines a spool passage 15 through which the working fluid flows toward the advance port 13 and the retard port 14. Moreover, as shown in FIGS. 3A and 3B, one end of the spool passage 15 is closed by a sliding plug 16 which is in contact with a driving shaft 6*a* of the electric actuator 6. The sliding plug 16 has a flow-direction-changing portion 17 which changes a fluid flow direction from a radial direction to an axial direction. The working fluid from the pump port 11 is introduced into the spool passage 15 by the flow-direction-changing portion 17.

A check valve 18 is provided in the spool passage 15. The check valve 18 permits a fluid flow from the flow-direction-changing portion 17 toward the spool passage 15 and prohibits a fluid flow from the spool passage 15 toward the flow-direction-changing portion 17. The check valve 18 is retained between an annular step 19 formed on inner wall surface of the spool passage 15 and the flow-direction-changing portion 17 of the sliding plug 16. The check valve 18 is a conically spiral spring valve made of spring steel.

(Configuration of VVT-controller)

The VVT-controller includes a VCT-mechanism 4 which rotates a shoe-housing 1 and a vane rotor 2 in a rotational direction relatively by using of a differential pressure between fluid in an advance chamber and fluid in a retard chamber, so that a rotational phase of a camshaft 3 connected to a vane rotor 2 is varied. Further, the VVT-controller includes the OCV 5 controlling the VCT-mechanism 4, the electric actuator 6 controlling the OCV 5, and the ECU electrically controlling the electric actuator 6.

(Explanation of VCT-mechanism 4)

The VCT-mechanism 4 has the shoe-housing 1 which is rotated in synchronization with a crankshaft of the engine, and the vane rotor 2 which rotates along with the camshaft 3 relative to the shoe-housing 1. A hydraulic actuator in the shoe-housing 1 rotates the vane rotor 2 relative to the shoe-housing 1 so that a rotational phase of the camshaft 3 is advanced or retarded.

As shown in FIG. 1, the shoe-housing 1 includes a sprocket 21 which is rotated through a timing belt or a timing chain by the engine, a front plate 22 attached to a front face of the sprocket 21, and a rear plate 23 attached to a rear face of the sprocket 21. These parts 21, 22, 23 are fastened together by a bolt 24. The vane rotor 2 is accommodated in the shoe-housing 1. The shoe-housing 1 has a plurality of fan-shaped concave portions which are aligned in a rotational direction.

The vane rotor 2 is connected to the camshaft 3. The vane rotor 2 has a plurality of vanes 2*a*, each of which divides the fan-shaped concave portion into an advance chamber and a retard chamber. The vane rotor 2 can rotate in a specified angle range relative to the shoe-housing 1.

The advance chamber is a hydraulic pressure chamber into which the working fluid (oil) is introduced in order to rotate the vane 2*a* in the advance direction. The retard chamber is also a hydraulic pressure chamber into which the working fluid is introduced in order to rotate the vane 2*a* in the retard direction.

The VVT-mechanism 4 has a lock device 26 which holds the rotational phase of the vane rotor 2 relative to the shoe-housing 1 at a proper position for starting the engine. The lock device 25 is comprised of a lock pin 26, which is provided to one of vanes 2*a*, a lock hole 27 in which the lock pin 26 is inserted, a spring 28 biasing the lock pin 26 toward the lock hole 27, and a lock-release mechanism 29 which disengages the lock pin 26 from the lock hole 27 by using of hydraulic pressure.

The lock pin 26 is slidably supported by the vane 2*a*. A rear end of the lock pin 26 is protruded by a specified length from a rear surface of the vane 2*a*. The lock hole 27 is formed on a front surface of the rear plate 23. A hard ring 27*a* is inserted into the lock hole 27 to reinforce the engaging portion. The spring 28 is a compression coil spring biasing the lock pin 26 toward the lock hole 27. A backpressure chamber where the spring 28 is disposed communicates with a drain space through an aperture. The lock-release mechanism 29 supplies a hydraulic pressure into a space between the lock pin 26 and a bottom of the lock hole 27 from the advance chamber and/or the retard chamber. When the hydraulic pressure becomes greater than the biasing force of the spring 28, the lock pin 26 is moved to disengage from the lock hole 27.

(Explanation of OCV 5)

The OCV 5 is for supplying the working fluid (oil) into the advance chamber or the retard chamber to generate a hydraulic pressure difference between the chambers so that the vane rotor 2 relatively rotates with respect to the shoe-housing 1.

The OCV 5 is comprised of a sleeve 7 connected to the camshaft 3, the spool 8 axially slidably supported in the sleeve 7, and the return spring 9 biasing the spool 8 in an axial direction opposite to a driving direction of the electric actuator 6.

(Explanation of Sleeve 7)

The sleeve 7 is cylindrical shaped. The sleeve 7 is inserted and threaded in an axial hole of the camshaft 3. The sleeve 7 rotates along with the vane rotor 2 and the camshaft 3. The sleeve 7 defines a cylindrical space in which the spool 8 axially slides.

The sleeve 7 has a plurality of input/output ports which extend radially. Specifically, the sleeve 7 has the pump port 11 through which pressurized oil is introduced therein, a front drain port 12*a* for returning the working fluid into the drain space, the advance port 13 communicating with the advance chamber, and the retard port 14 communicating with the retard chamber. Further, the sleeve 7 has a rear drain port 12*b* communicating with a drain space through the axial hole of the camshaft 3.

More specifically, the pump port 11 is formed at a position close to a rear end of the sliding plug 16. The pump port 11 is fluidly connected to a discharge port of an oil pump through a first gate 31 formed in the camshaft 3 and a shaft bearing. The working fluid (oil) discharged from the oil pump is introduced into the pump port 11.

The front drain port 12*a* communicates with a drain space through a second gate 32 formed in the camshaft 3. The working fluid is discharged into the drain space through the front drain port 12*a*. The advance port 13 communicates with the advance chamber through the third gate 33 formed in the camshaft 3 and the advance passage 34 formed in the vane rotor 2. The retard port 14 communicates with the retard chamber through the fourth gate 35 formed in the camshaft 3 and the retard passage 36 formed in the vane rotor 2.

(Explanation of Spool 8)

The spool 8 is cylindrical shaped. The spool passage 15 is defined in the spool 8. The spool passage 15 is an inner passage for introducing the working fluid into the advance port 13 and the retard port 14.

The spool 8 is inserted into the sleeve 7. A small clearance is formed between the spool 8 and the sleeve 7. The spool 8 axially slides in the sleeve 7, so that the rotational phase of the camshaft 3 is advanced, held, or retarded.

The spool 8 has a first penetrating port 41, a circumferential groove 42, a second penetrating port 43, a discharge-communicating portion 44 and an oil-port-closing wall 45. Besides, a penetrating slit and a rear opening correspond to the discharge-communicating portion 44 in FIG. 1. A small-diameter end portion corresponds to the discharge-communicating portion 44 in FIGS. 3A and 3B.

The first penetrating port 41 always communicates with the pump port 11 for introducing the working fluid into the spool 8. The circumferential groove 42 always communicates with the front drain port 12*a*. Only when the spool 8 slides rearward (rightward in FIGS. 3A and 3B) in the sleeve 7, the front drain port 12*a* communicates with the advance port 13 through the circumferential groove 42.

When the spool 8 slides forward (leftward in FIGS. 3A and 3B) in the sleeve 7, the second penetrating port 43 communicates with the advance port 13. When this spool 8 slides rearward in the sleeve 7, the second penetrating port 43 communicates with the retard port 14. Only when the spool 8 slides forward, the discharge-communicating portion 44 fluidly connects the retard port 14 and the rear drain port 12*b*. The oil-port-closing wall 45 is a partition wall which interrupts a communication between the spool passage 15 and the axial hole.

A front portion of the spool 8 functions as a sealing portion (land portion) which restricts a leakage of the working fluid from the pump port 11 to front portion of the axial hole. The peripheral wall between the first penetrating port 41 and the circumferential groove 42 functions as a sealing portion (land portion) which restricts a leakage of the working fluid from the pump port 11 to the front drain port 12*a*. The peripheral wall between the circumferential groove 42 and the second penetrating port 43 functions as a land portion which closes the advance port 13 according to an axial position of the spool 8. The peripheral wall between the second penetrating port 43 and the discharge-communicating portion 44 functions as a land portion which closes the retard port 14 according to an axial position of the spool 8.

(Explanation of Sliding Plug 16)

The sliding plug 16 is press-inserted into the spool 8. The sliding plug 16 receives a driving force from the electric actuator 6 and closes a front end portion of the spool passage 15. The sliding plug 16 is always in contact with the driving shaft 6*a* of the electric actuator 6. The sliding plug 16 has a convex portion where the driving shaft 6*a* is in contact with.

As shown in FIGS. 3A and 3B, the sliding plug 16 has the flow-direction-changing portion 17 at its rear end. The flow-direction-changing portion 17 changes a fluid flow direction from a radial direction to an axial direction. That is, the working fluid flows through the pump port 11 and the first penetrating port 41 in a radial direction, and then flows into the spool passage 15 in the axial direction. The flow-direction-changing portion 17 includes a ring portion 17*a* and a plurality of bridge portions 17*b*. The ring portion 17*a* has an outer diameter which is substantially equal to an inner diameter of the spool passage 15. The bridge portions 17*b* connect the ring portion 17*a* and the sliding plug 16 through an axial clearance.

The axial space between the sliding plug 16 and the ring portion 17*a* always communicates with the first penetrating port 41. The flow of the working fluid is shown by an arrow "X" in FIG. 3B.

(Explanation of Check Valve 18)

While the engine is ON, a vane rotor 2 of the VVT-controller receives torque fluctuations transmitted to the camshaft 3. The hydraulic pressure in the advance chamber and the retard chamber fluctuates due to the torque fluctuations. As a result, the hydraulic pressures in the advance chamber and the retard chamber alternately increase and decrease due to the torque fluctuations. If the hydraulic pressure in the advance chamber and the retard chamber exceeds the hydraulic pressure supplied from the oil pump, a reverse flow of the working fluid is generated, which deteriorates the responsiveness of the VVT-controller. In order to restrict such a deterioration in responsiveness of the VVT-controller, a check valve 18 is provided in an oil-supply passage so as to prevent a reverse flow from the chambers to an oil pump.

In this embodiment, the check valve 18 is disposed in the spool passage 15. The check valve 18 is provided in the spool passage 15. The check valve 18 permits a fluid flow from the flow-direction-changing portion 17 toward the spool passage 15 and prohibits a fluid flow from the spool passage 15 toward the flow-direction-changing portion 17.

Figure 2A:
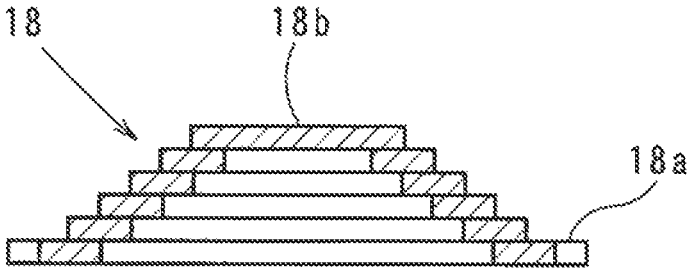
FIG. 2A is a cross sectional view showing a conically spiral spring valve.
Figure 2B:
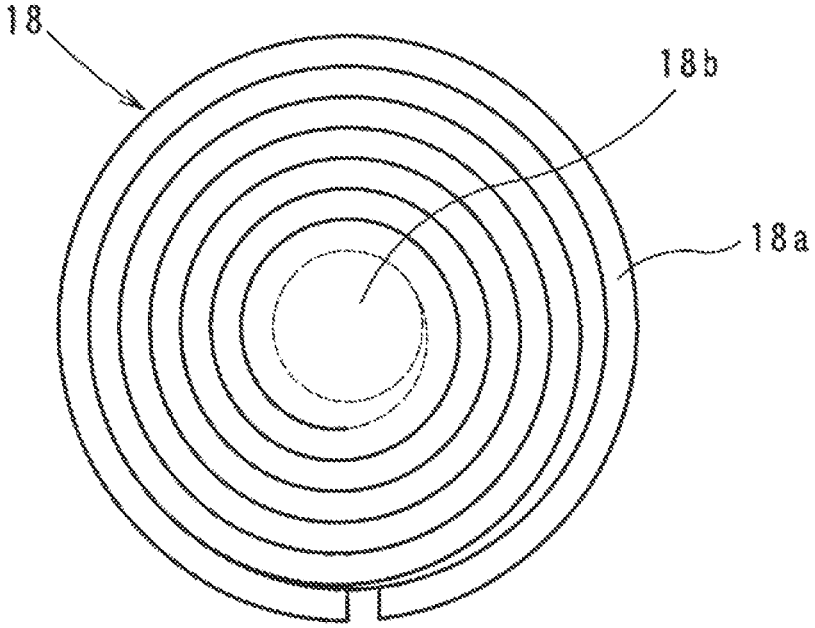
FIG. 2B is a top view of the conically spiral spring valve.

Specifically, the check valve 18 is a conically spiral spring valve which has multiple windings. When viewed in an axial direction, adjacent windings overlap with each other at overlap portions. The check valve 18 is retained between the annular step 19 formed on the inner wall surface of the spool passage 15 and the ring portion 17*a* of the flow-direction-changing portion 17. Referring to FIGS. 2A and 2B, the configuration of the check valve 18 will be specifically described hereinafter.

As shown in FIG. 2A, a cross-section of each winding is rectangle which has a flat surface orthogonal to the axial direction of the check valve 18. When the check valve 18 has no load, that is, when the check valve 18 is in a free condition, the overlap portion of each winding is in contact with each other. It should be noted that a spring force of the check valve 18 is set relatively small. When the check valve 18 receives an external force in its extending direction, the check valve 18 easily extends in its axial direction, as shown in FIG. 2B. The overlap portion of each winding is apart from each other.

A most outer periphery 18*a* of the check valve 18 is clamped between the annular step 19 and the ring portion 17*a*. Furthermore, at a top portion of the conically shaped check valve 18, a lid member 18*b* is provided. When the check valve 18 is shrunk in its axial direction as shown in FIG. 3A, the lid member 18*b* closes the top portion of the check valve 18. This lid member 18*b* is disk-shaped and has a flat surface orthogonal to the axial direction of the check valve 18.

(Explanation of Return Spring 9)

The return spring 9 is a compression coil spring biasing the spool 8 leftward in FIG. 1. The return spring 9 is arranged in a spring chamber 46 between a rear end wall of the sleeve 7 and a rear end wall of the spool 8.

(Explanation of Actuator 6)

The electric actuator 6 moves the sliding plug 16 rearward against a biasing force of the return spring 9, whereby the axial position of the spool 8 is controlled. The electric actuator 6 is comprised of a coil, a stator, and a plunger.

(Explanation of ECU)

The ECU computes an advance quantity of the camshaft 3 according to an engine driving state, and energizes the electric actuator 6 so that the VCT-mechanism 4 advances the camshaft 3. The axial position of the spool 8 is varied to control the hydraulic pressure in the advance chamber and the retard chamber, whereby the advance quantity of the camshaft 3 is controlled.

(Explanation of Advance Operation)

When advancing the camshaft 3, the ECU increases the supply current to the electric actuator 6. The driving shaft 6*a* and the spool 8 move rearward. The pump port 11 communicates with the advance port 13 through the first penetrating port 41, the spool passage 15 and the second penetrating port 43. The retard port 14 communicates with the rear drain port 12*b* through the discharge-communicating portion 44 and the spring chamber 46.

As a result, the hydraulic pressure in the advance chamber increases and the hydraulic pressure in the retard chamber decreases conversely. The vane rotor 2 is rotated in an advance direction relative to the shoe-housing 1 so that the rotational phase of the camshaft 3 is advanced. The above advance operation will be described more in detail, hereinafter.

When the pump pressure is greater than the hydraulic pressure in the advance chamber the check valve 18 is opened so that the working fluid flows into the advance chamber, as shown in FIG. 3B. As the result, the vane rotor 2 is rotated in an advance direction relative to the shoe-housing 1 so that the rotational phase of the camshaft 3 is advanced.

When the hydraulic pressure in the advance chamber becomes greater than the pump pressure, the check valve 18 is closed to avoid a reverse flow of working fluid toward the oil pump. It can be restricted that the rotational phase of the vane rotor 2 fluctuates due to the reverse flow of the working fluid.

(Explanation of Phase Holding)

When holding the advanced position of the camshaft 3, the ECU controls the supply current to the actuator 6 so that the spool 8 closes the advance port 13 and the retard port 14. Thus, by closing both the advance port 13 and the retard port 14, the hydraulic pressure in the advance chamber and the retard chamber are held constant so that the advance position of the camshaft 3 is held.

(Explanation of Retard Operation)

When retarding the camshaft 3, the ECU decreases the supply current to the electric actuator 6. The driving shaft 6*a* and the spool 8 moves forward. The pump port 11 communicates with the retard port 14 through the first penetrating port 41, the spool passage 15 and the second penetrating port 43. The advance port 13 communicates with the front drain port 12*a* through the circumferential groove 42.

As a result, the hydraulic pressure in the retard chamber increases and the hydraulic pressure in the advance chamber decreases conversely. The vane rotor 2 is rotated in a retard direction relative to the shoe-housing 1 so that the rotational phase of the camshaft 3 is retarded. The above advance operation will he described more in detail, hereinafter.

When the pump pressure is greater than the hydraulic pressure in the retard chamber, the check valve 18 is opened so that the working fluid flows into the retard. As a result, the vane rotor 2 is rotated in the retard direction relative to the shoe-housing 1 so that the rotational phase of the camshaft 3 is retarded.

When the hydraulic pressure in the retard chamber becomes greater than the pump pressure, the check valve 18 is closed to avoid a reverse flow of working fluid toward the oil pump. It can be restricted that the rotational phase of the vane rotor 2 fluctuates due to the reverse flow of the working fluid.

(Advantages of Embodiment)

When the check valve 18 is opened, a plurality of fluid-passage clearances are ensured between the windings, as shown in FIG. 3B. Thus, a pressure loss of the working fluid can be reduced and the responsiveness of the VVT-controller can be improved.

When a reverse flow of the working fluid is generated, the check valve 18 receives the reverse flow at its large area, as shown in FIG. 3A. Thus, the reverse flow of the working fluid can be utilized as a thrust force in a close direction of the check valve 18. A valve closing responsiveness of the check valve 18 and the responsiveness of the VVT-controller can be improved.

The sliding plug 16 has the flow-direction-changing portion 17 which changes a fluid flow direction from a radial direction to an axial direction. The working fluid from the pump port 11 is introduced into the spool passage 15 by the flow-direction-changing portion 17. As shown by an arrow "X" in FIG. 3B, the working-fluid flow direction is changed into an axial flow direction directing to the check valve 18. Thus, the direction of the working fluid flow is coincident with a valve opening direction of the check valve 18. For this reason, a valve-opening-responsiveness of the check valve 18 is enhanced, so that the responsiveness of the VVT-controller is also enhanced.

The check valve 18 is retained between the annular step 19 formed on the inner wall surface of the spool passage 15 and the ring portion 17*a* of the flow-direction-changing portion 17. Thus, the check valve 18 can be fixed in the spool 8 with a simple configuration and low cost.

In the check valve 18, a cross-section of each winding is rectangle which has a flat surface orthogonal to the axial direction of the check valve 18. When a reverse flow is generated, the flat surface of each winding receives the reverse flow. Thus, the reverse flow of the working fluid can be utilized as a thrust force in a close direction of the check valve 18. A valve closing responsiveness of the check valve 18 can be improved.

The check valve 18 is a conically spiral spring valve which has multiple windings. When a reverse flow is generated, every winding receives the reverse flow. Thus, the reverse flow of the working fluid can be utilized as a thrust force in a close direction of the check valve 18. A valve closing responsiveness of the check valve 18 can be improved.

[Modifications]

A cross-section of the wire of the check valve 18 may be circle or ellipse. The check valve 18 may be a cylindrically spiral spring valve. The sliding plug 16 is fixed to the spool 8 by threading or welding. Instead of the electric actuator 6, a fluid actuator can be used for driving the spool 8. The VVT-controller may be used for adjusting a rotational phase of an exhaust camshaft and/or an intake camshaft.

What is claimed is:

1. A valve timing controller which varies a rotational phase of a camshaft relative to a crankshaft of an internal combustion engine, comprising:

a variable-camshaft-timing mechanism which adjusts a rotational phase of the camshaft by using of a differential hydraulic pressure between a pressure in an advance chamber and a pressure in a retard chamber;

an oil flow control valve which controls the differential hydraulic pressure; and an electric actuator which drives the oil flow control valve, wherein:

the oil flow control valve is provided with a sleeve having a pump port through which a pressurized working fluid is introduced therein, a drain port communicating with a drain space, an advance port communicating with an advance chamber and a retard port communicating with a retard chamber, and a spool slidably accommodated in the sleeve in its axial direction in order to adjust a communicating condition of each port;

the spool comprising a spool sleeve and defining a spool passage through which the working fluid flows toward the advance port and the retard port;

the spool is provided with a sliding plug which closes one end of the spool passage and is in contact with a driving shaft of the electric actuator;

the sliding plug has a flow-direction-changing portion which changes a fluid flow direction from a radial direction to an axial direction so that the working fluid is introduced into the spool passage;

a check valve is provided in the spool passage in such a manner that the check valve permits a fluid flow from the flow-direction-changing portion toward the spool passage and prohibits a fluid flow from the spool passage toward the flow-direction-changing portion;

the check valve is a spiral spring valve which has multiple windings;

each of the windings is formed in such a manner as to come in contact with each other in an axial direction thereof; and the check valve is retained between an annular step formed on an inner wall surface of the spool sleeve and the flow-direction-changing portion.

2. A valve timing controller according to claim 1, wherein each of the windings of the check valve has a rectangular cross-section including a flat surface which is orthogonal to the axial direction of the check valve.

3. A valve timing controller according to claim 1, wherein the check valve is a conically spiral spring valve having an outer diameter which decreases along a direction opposite to the sliding plug.

* * * * *